US005396723A

United States Patent [19]

Liu

[11] Patent Number: 5,396,723

[45] Date of Patent: Mar. 14, 1995

[54] CRYSTAL BALL WITH DISPLACEABLE SPOUT

[76] Inventor: Jian H. Liu, No. 3, Alley 202, Kao Fen Rd., Hsin-Chu City, Taiwan, Prov. of China

[21] Appl. No.: 132,235

[22] Filed: Oct. 6, 1993

Related U.S. Application Data

[63] Continuation of Ser. No. 745,279, Aug. 14, 1991, abandoned.

[51] Int. Cl.[6] ..... G09F 19/00

[52] U.S. Cl. ..... 40/406; 40/407

[58] Field of Search ..... 40/406, 407, 409, 412, 40/439, 440, 477, 427

[56] References Cited

U.S. PATENT DOCUMENTS

| | | | |
|---|---|---|---|
| 3,814,318 | 6/1974 | Michaelis | 40/407 |
| 4,864,752 | 9/1989 | Kent | 40/437 |
| 4,986,531 | 1/1991 | Snaper et al. | 40/407 |

*Primary Examiner*—Peter R. Brown
*Assistant Examiner*—Cassandra Davis
*Attorney, Agent, or Firm*—Larson and Taylor

[57] ABSTRACT

A crystal ball has a rotatable and vertically movable liquid dispensing spout inside a glass ball. The crystal ball also has a fixture frame for converting the rotational motion of a flexible shaft driven by a music box or bell into a rotational and a reciprocal axial movement for a main shaft. The fixture frame is comprised of a lower lid having a sinusoidal guide rail on the inner walls that is engaged by axial projections or columns depending from the sides of an upper lid. Also a pump housing is associated with the upper lid of the fixture frame, and a piston disk sleeved at a proper position on the main shaft, produces a compression as a result of its relative motion in the space defined by the housing. The piston pumps a colorful fluid loaded in the housing of the pump up to the spout for a sprayed ejection which produces the effect of a kaleidoscopical, dynamic variation of a fantastic crystal ball.

19 Claims, 4 Drawing Sheets

CRYSTAL BALL WITH DISPLACEABLE SPOUT

This application is a continuation of application Ser. No. 07/745,279, filed Aug. 14, 1991, now abandoned.

FIELD OF THE INVENTION

The present invention relates to crystal balls, and in particular relates to crystal balls having a rotatable fixture which is driven from the power of a spring-wound music box.

BACKGROUND OF THE INVENTION

Conventionally, a crystal ball has internal embellishments or features that are limited to the rotation of a figure inside a crystal ball which yields only simple visual variations. However, this is opposed to the modern trend in designs of crystal balls where the theme is such that more varied and enriched features are desired. These requirements for a more complex visual variation have rendered the old-fashioned design of a crystal ball inadequate to meet modern demands. Accordingly, there is a challenge to a present day conscientious designer to improve the structure of a conventional crystal ball so that the ball is rife with features. The demonstration of such features can include, for example, rotation and vertical movements as well as the spraying of a fluid within the crystal ball.

SUMMARY OF THE INVENTION

A crystal ball according to a preferred embodiment of the present invention utilizes a music box to rotate an elastic shaft, which in turn rotates a disk mounted at the bottom of a stationary frame. An embellishment inside the glass enclosure of the crystal ball is coupled to the disk which causes both the rotation and axial displacement of the embellishment. A pump housing that is pivotally associated with the upper lid of the frame together with a pump piston disk, or piston pieces, mounted to the shaft of a pump coupled to the embellishment, deliver colored fluid stored in the pump housing through the pump shaft to a spout at the top of the embellishment, and thence out of the spout creating quite a sensational view.

Accordingly, it is a primary object of the present invention to utilize the basic structure of a conventional crystal ball installation so as to enable the embellishment to spray or eject colorful fluids from a spout within the crystal ball. The liquids are ejected as a result of the reciprocal up-and-down movement of the spout which takes place as the ball rotates on course.

A further object of the invention is to add a diversified feature of the conventional crystal ball installation by making it possible for colorful fluids, confined within a pump housing, to be delivered by a compression stroke of a piston within a spout.

In a particular embodiment, the spout provides for the delivery of the fluid as a result of a piston that is coaxially or sleevingly provided in a pump housing, which in turn, is pivotally interconnected with an upper lid of a fixture frame. Also in a particular embodiment, the rotation of a main shaft is translated into the reciprocal axial or vertical movement by coupling the rotation of the main shaft to transversely or radially extending arms of a pump shaft. The extremities of the arms engage a sinusoidal groove in the inner peripheral wall of a frame which drive the arms in the vertical or axial direction. The main shaft is keyed to a rotation disk having upstanding guide columns which engage either side of the pump shaft arms and rotate the arms while permitting their axial movement.

DESCRIPTION OF THE PREFERRED EMBODIMENT

Figure 1:
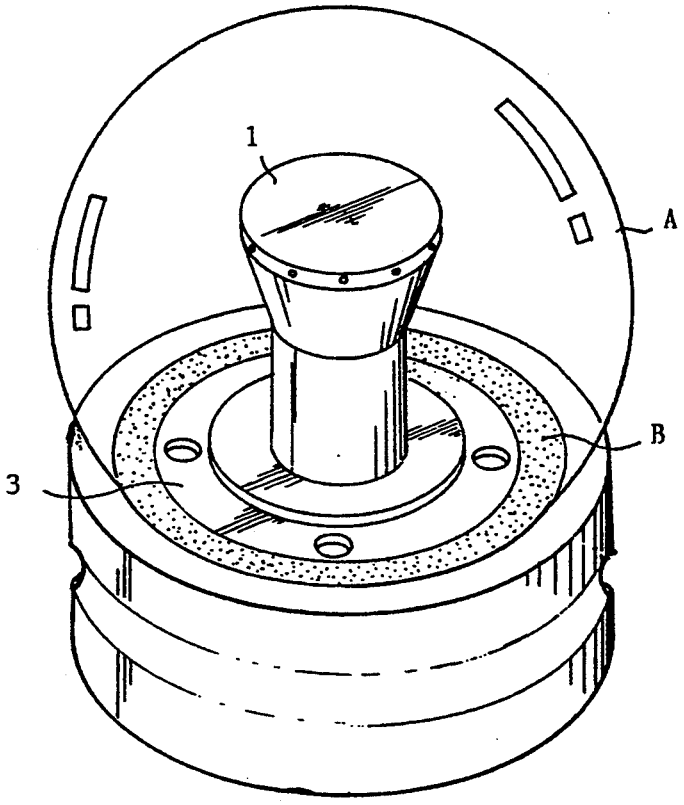
FIG. 1 is a perspective view of the external appearance of a crystal ball according to the present invention.

Referring to the figures in which like numerals represent like elements throughout the several views, and in particular referring to FIG. 1, it is seen that in this embodiment of the invention, a crystal ball includes a glass, substantially spherical, cover or container A which contains pure water, an embellishment 1 inside cover A, and a hollow fixture frame 3 which is concentrically mounted within a rubber cushion B, and which has its top flush therewith. In addition thereto, crystal ball A and fixture frame 3 contain inside colored liquids whose specific gravity is greater than that of pure water. The surface of the colored fluids is at least at a level sufficient to cover the top end of fixture frame 3, and if desired can be above fixture frame 3 covering part of embellishment 1.

Figure 2:
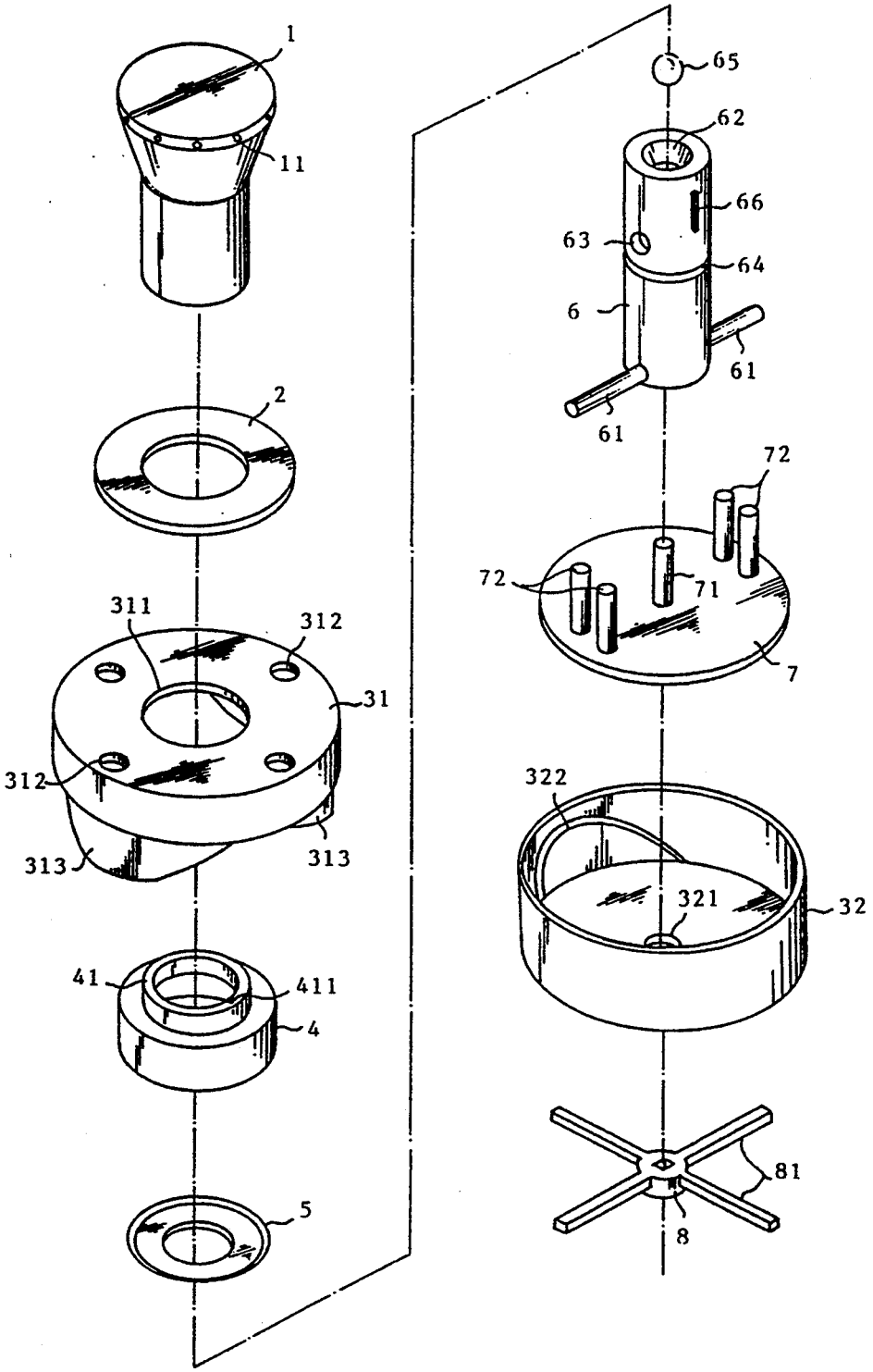
FIG. 2 is an exploded perspective view of the internal components of a crystal ball according to the present invention.
Figure 3:
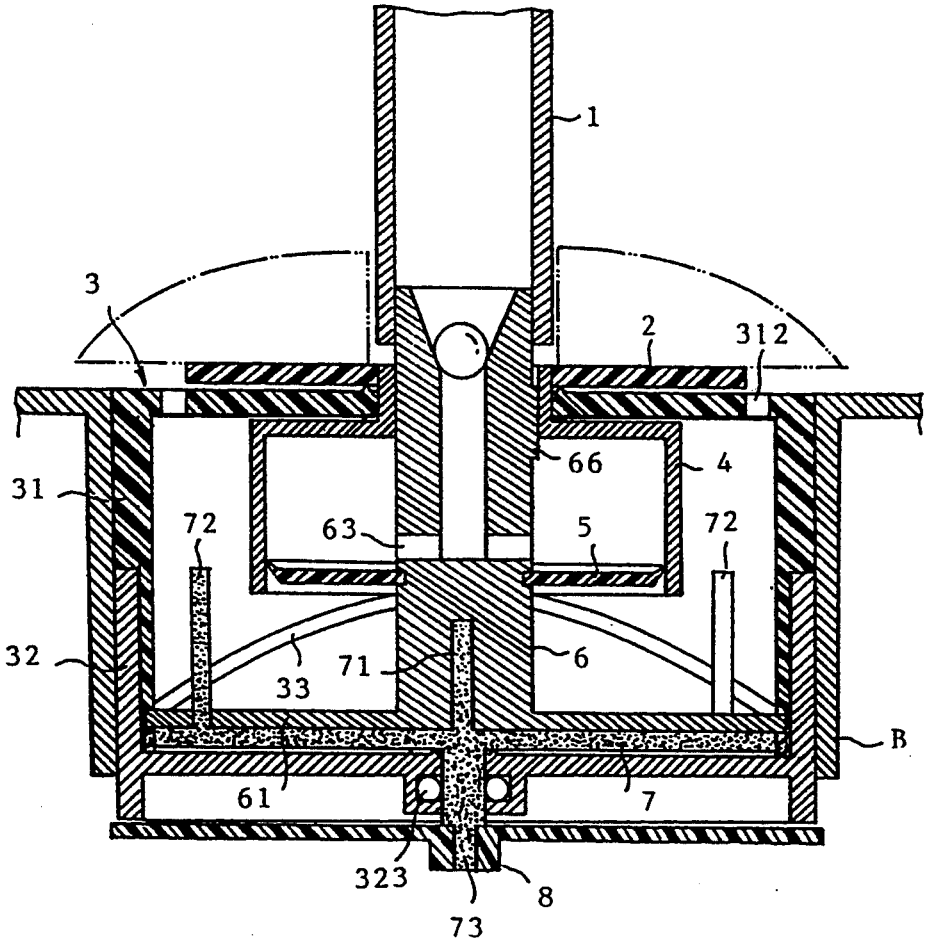
FIG. 3 is a front elevational view in cross-section of a main shaft of the internal components when the shaft is in a lowermost position.

As seen in FIGS. 2 and 3, fixture frame 3, in the capacity of a hollow cylindrical container for the aforementioned colored liquids contains in fact an enclosed space and is comprised of an upper lid 31 concentrically mounted or sleeved-coupled around a lower lid 32. It is noted that at a point at the top end of upper lid 31 there is provided a central orifice 311 for mounting other elements through which the colored liquids can be discharged, and which is complimented with a plurality of intake or influx holes 312 located about its periphery. Further, surrounding the lower rim of upper lid 31 is a counterpart flange 313 which includes two interacting axial projections which project axially downwardly and which have undulated end portions.

Lower lid 32 is adapted or configured to be coupled within upper lid 31. Lower lid 32 is also provided with a passage hole 321 in the bottom center thereof, plus an upstanding lower flange 322 formed around the inner wall perimeter thereof to correspond to, but to be spaced or offset from upper flange 313 that is part of upper lid 31.

When lower lid 32 is mounted within upper lid 31, spaced apart flanges 313 and 322 result in or produce a guide rail 33. It is thus this suitable clearance between opposing upper flange 313 and lower flange 322 that is the guide rail 33. Guide rail 33 thus has an undulated or sinusoidal configuration around the inner periphery of fixture frame 3.

There is also provided a cylindrical pump casing 4 which has a smaller diameter than upper lid 31 and which is provided with a neck or annular flange 41 on the top thereof. Neck 41 is journalled or sleeved into orifice 311 of upper lid 31 and is rotatably retained therein by a support pan 2 having a relatively large diameter and mounted on the upper end of neck 41 (see FIG. 3). Thus, pump casing 4 supported in this way by support pan 2, can enjoy a free rotation with respect to orifice 311.

On the inside bottom of lower lid 32, there is mounted thereon a rotation disk 7 having the same diameter as the inner diameter of lower lid 32. Rotation disk 7 includes a penetration shaft 73 depending from the center thereof and is mounted on a resilient shaft 8 having a central hole adapted to received penetration shaft 73 and further having four resilient arms 81 integral therewith. Penetration shaft 73 extends through penetration hole 321 in the center of lower lid 32. Resilient shaft 8 includes a resilient coupling that is comprised of a bifurcated lower shaft (not shown), the tines of which (not shown) engage in between arms 81. A music bell or box assembly (also not shown) rotates the lower shaft, which rotates shaft 8 which in turn transmits that rotation to rotation disk 7 which rotates relative to the bottom of lower lid 32.

Two pairs of mutually complementing guide columns 72 extend upwardly from and are rigidly mounted to the top of rotation disk 7 near the axle thereof. Rotation disk 7 has a centrally mounted central stem 71 which has a selected height of a suitable amount.

A main or pump shaft 6 penetrates neck 41 of aforementioned pump casing 4, and is provided at the bottom thereof with a transversely or radially extending, cylindrical arm or member 61 which is essentially a cam follower. The diameter of the cross section of cylindrical member 61 corresponds to the thickness of and is received by guide rail 33 formed on the peripheral wall of fixture frame 3. Cylindrical member 61 has a length such that the two ends thereof span across the bottom of rotation disk 7 and enter into and engage guide rail 33. Cylindrical member 61 is also confined between the individual columns of both pairs of guide columns 72 so that it will rotate with rotation disk 7, yet still be able to move axially with respect thereto.

The foregoing structure is characterized in that as rotation disk 7 rotates as a result of the rotation of resilient shaft 8 at the bottom of fixture frame 3, guide columns 72 will rotate cylindrical member 61. This drives main shaft 6 in a corresponding rotation. Also, because cylindrical member 61 is position spanning across and located in guide rail 33, which essentially provides a cam surface as shaft 6 rotates, and cylindrical member 61 follows the undulated guide rail 33, main shaft 6 is simultaneously moved up and down, or is moved reciprocally in the axial direction. This rotational and reciprocal motion is viewed by an observer through crystal ball A and presents a spectacle of dynamic, undulated movement of crystal ball A by virtue of its embellishment 1 that is linked with the top side of main shaft 6.

Furthermore, on the upper end of main shaft 6 is a longitudinal or axial bore 62 having a suitable depth and which is in communication with a transverse or radial extending bore 63 located at the bottom of axial bore 62. The bottom of axial bore 62, and hence radial bore 63 is located slightly below the half way point of main shaft 6. Just below radial bore 63 is an annular slot 64 encircling main shaft 6, thereby forming a coulisse. An annular piston piece 5 is mated with annular slot 64.

Piston piece 5 has an annular upturned flange on its parameter that is made from a piece of soft rubber. The diameter of piston piece 5 is equal to the inner diameter of pump casing 4.

The foregoing structure is such that when main shaft 6 is at its lowermost position, as illustrated in FIG. 3, the corresponding position of piston piece 5 is near the lower end of pump casing 4. Thus, when main shaft 6 is driven axially upwardly, the space inside pump casing 4 is compressed, and the colored liquids contained therein are forced upwardly and outwardly, being ejecting out of a spout nozzle 11 by way of radial bore 63, axial bore 62, and through embellishment 1. The colorful liquids thus ejected return by flowing through intake holes 312 located on the top of fixture frame 3, into the inner cavity of fixture frame 3 for repeated recycling.

Figure 4:
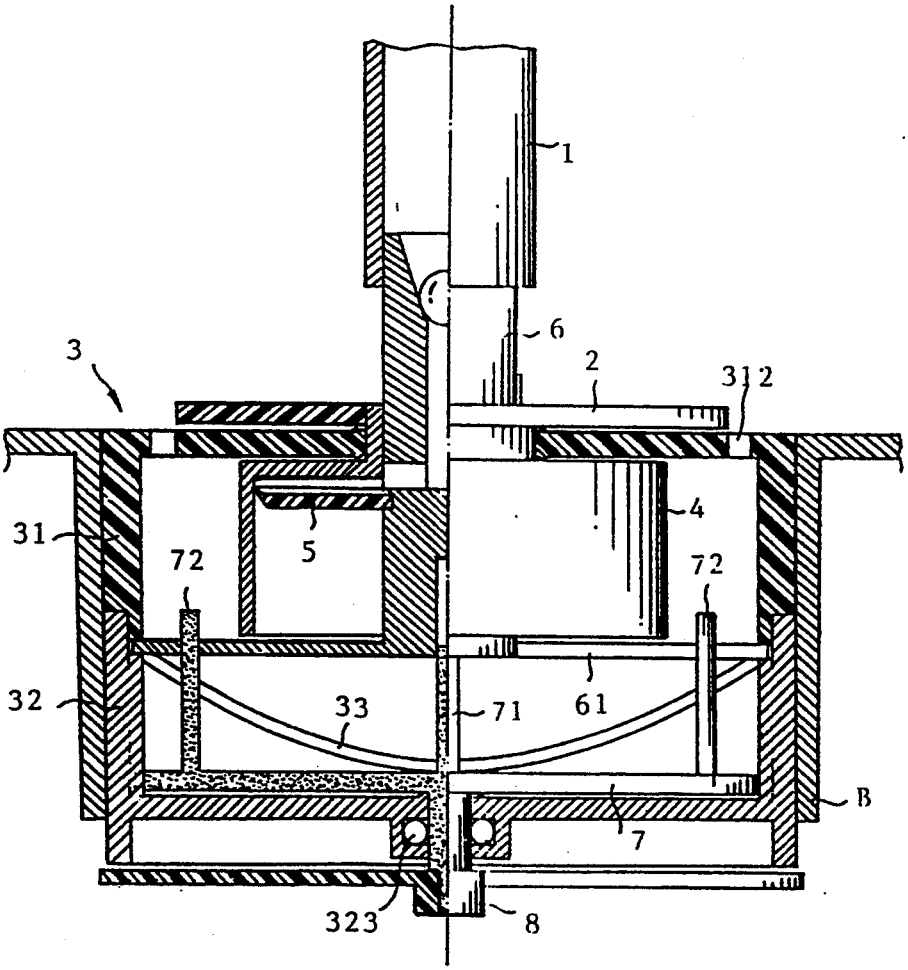
FIG. 4 is a front elevational view, partly in cross-section, of the main shaft when in an uppermost position.

After main shaft 6 is driven to its uppermost or topmost position, as illustrated in FIG. 4, it will then start moving downwardly. It is thus necessary to prevent the colored liquids previously residing in embellishment 1 from absorbing the pure water through spout nozzle 11. This occurs because of the suction that results from the downward displacement of piston piece 5. Otherwise, if not prevented, it would result in a failure of the demonstration of the colored liquids in a subsequent cycle of discharge or ejection.

To prevent this mixing, a one-way valve is provided as follows. A countersunk hole is located at the upper end of main shaft 6 and is coaxial and in communication with axial bore 62. Located inside this countersunk hole is a steel ball 65 that has a larger diameter than the diameter of axial bore 62. The size and shape of the countersunk hole corresponds to the size and shape of steel ball 65 such that a one-way valve is produced, which valve will suffice to effectively prevent water from being sucked in through spout nozzle 11.

Since the suction produced in pump casing 4 by piston piece 5 in its downward motion cannot expect recompensation through spout nozzle 11 as given on embellishment 1, the recompensation occurs around the periphery of piston pieces. This is because the perimeter of piston piece 5 is upturned and is made from a soft rubber. Thus the suction produced as described above, compels the perimeter of piston piece 5 to deform, whereupon the colored liquids may get sucked into pump casing 4 between the periphery of the inner diameter of pump casing 4 and with the perimeter of piston piece 5 which is therewith in contact.

Moreover, because the inner parameter of pump casing 4 is in contact with piston piece 5, should pump casing 4 not be rotating in synchronization with main shaft 6, a frictional resistance will undoubtedly prevail between piston piece 5 and pump casing 4. In consideration of this possibility, a recess 411 is provided on the interior periphery of neck 41 of pump casing 4. This is complemented with keys or lugs 66 of a suitable length, axially located around main shaft 6. Lugs 66 mate with recess 411, as stated above, so that main shaft 6 can by means of lugs 66, bring pump casing 4 to a simultaneous rotation therewith as well as permit sliding movement of the lugs relative to recess 411. In this way, there is no interference with the up-and-down or axial movement of main shaft 6.

In addition, to safeguard the stability of main shaft 6 in its functional movements so as to avoid unnecessary and unwanted deviation with its concomitant undesirable increase in friction and/or decrease in compression, central stem 71 has a suitable length and interacts with the terminal tip of main shaft 6 in the central position of the upper side of rotation disk 7. Thus, central stem 71 helps to secure the stability of the lower part of main shaft 6.

Also, because the interior crystal ball container A, or else of fixture frame 3, is filled full of liquids, an oil seal 323 which mates with the projected penetration shaft 73 is mounted in passage hole 321 in lower lid 32 of fixture frame 3. This arrangement ensures a watertight feature of the interior of crystal ball container A.

In summary, the present disclosure should be enlightening and obvious enough to those skilled in the art that they realize that the present invention provides a greater appreciated, more diversified spectacle than from a convention crystal ball device. The improvement includes a dynamic demonstration of the embellishment in rotation combined with a reciprocal axial movement which results in the discharge of colored fluids or liquids from the top side of the embellishment.

As should be obvious, embellishment 1 can take any shape, pattern or form. For example, it can be a fish, dragon, snake, or other animal or character, such as those commonly portrayed in cartoon layouts. These characters are in consideration of a particular figure or protagonist. As such the depth of the colored fluids to be employed can be adjusted when needed so that the animal portrayed to the viewer is just submerged by the colored liquids at a lowest level. On the other hand, colored liquids can be ejected from the mouth of the animal when it emerges out of the surface. This will doubtlessly prove humorous and interesting to the viewers and bystanders irrespective of his or her sex or age. Thus, young and old, men and women can enjoy a crystal ball according to the present invention.

Obviously, other efforts can be addressed to modifications, variations and changes which are, needless to say, included generally in the scope of the claims set forth herein.

What is claimed is:

1. A crystal ball assembly comprising:
a transparent cover;
a base onto which said cover is sealingly mounted;
a spout mounted inside said cover; and
pumping means for pumping a fluid out through said spout, said pumping means comprising
a stationary frame which has an interior chamber and includes
a top having an upper surface, a central bore and a plurality of peripherally located orifices therethrough, and
a bottom coupled together with said top to form said chamber, said bottom having a central bore, and
a pump casing rotatably mounted at said frame top inside said chamber and having an interior wall which defines an interior cavity,
a pump shaft extending through said pump casing and rotatably and axially slidably mounted in said frame, said pump shaft having an axial bore therein in fluid communication with said pump casing cavity and said spout, and said spout being mounted on said pump shaft,
moving means for rotating and axially reciprocating said pump shaft, and
pump piston means mounted on said pump shaft and located inside said pump casing cavity for forcing a fluid in said pump casing cavity out said pump shaft bore and out said spout.

2. A crystal ball assembly as claimed in claim 1 and further comprising an annular resilient cushion having a top portion and mounted inside said cover, said frame being coaxially mounted inside said cushion such that said frame top is substantially coplanar with said cushion top portion.

3. A crystal ball assembly as claimed in claim 1 and further comprising a liquid seal mounted in said frame bottom bore, and wherein said moving means includes a rotatable shaft extending through said seal and coupled to said pump shaft.

4. A crystal ball assembly as claimed in claim 1 wherein said moving means comprises an axial moving means which in turn comprises a cam follower mounted on said pump shaft and an undulating cam surface in said frame.

5. A crystal ball assembly as claimed in claim 4 wherein said cam follower is comprised of a radially projecting arm rigidly mounted to said pump shaft and engaging said cam surface.

6. A crystal ball assembly as claimed in claim 4 wherein said cam surface is part of an undulating guide rail, said guide rail defined by axial projections depending from said frame top and mating flanges upstanding on said frame bottom spaced apart from said axial projections.

7. A crystal ball assembly as claimed in claim 6 wherein said cam follower is comprised of a radially projecting arm having an end, said arm being rigidly mounted to said pump shaft and engaging said guide rail with said arm end.

8. A crystal ball assembly as claimed in claim 7 wherein said projecting arms have two ends extending perpendicular from said pump shaft and engaging opposite portions of said guide rail.

9. A crystal ball assembly as claimed in claim 4 wherein said moving means includes a rotational moving means which in turn comprises a disk rotatably mounted on said frame bottom and comprised of a plurality of upstanding columns mounted spaced apart on either side of said cam follower so as to rotate said cam follower and hence said pump shaft and so as to permit axial movement of said pump shaft and cam follower with respect to said disk.

10. A crystal ball assembly as claimed in claim 9 wherein said disk further includes an upstanding central post, and wherein said pump shaft has a bottom and includes a central bore through said pump bottom for slidingly receiving said disk central post, said pump shaft central and said disk post having lengths so as to accommodate the full axial movement of said pump shaft.

11. A crystal ball assembly as claimed in claim 1 wherein said pumping means further comprises a check valve in central bore which only permits upward fluid flow.

12. A crystal ball assembly as claimed in claim 11 wherein said pump casing comprises an upstanding hollow neck portion extending through said frame top bore and having an interior surface, said neck portion slidably receiving said pump shaft therein;
and a means for locking together said pump shaft and said pump casing neck portion for joint rotational movement, said locking means comprising an axially extending slot on one of said pump shaft and said interior surface of said pump casing neck portion and a lug rigidly mounted on the other of said pump shaft and said neck portion interior surface of said pump casing, said lug engaging said slot, said lug and slot having a length such that said lug stays engaged in said slot at the extremes of the axial movement of said pump shaft.

13. A crystal ball assembly as claimed in claim 12 wherein said pumping means further comprises pump casing mounting means for rotatably mounting said pump casing neck portion inside and extending above said frame top bore, said pump casing mounting means comprising a support pan rigidly attached to a top portion of said pump casing neck portion that extends above said frame top.

14. A crystal ball assembly as claimed in claim 1 wherein said pumping means further comprises a check valve in central bore which only permits upward fluid movement.

15. A crystal ball assembly as claimed in claim 1 wherein said piston means comprises an annular disk mounted around said pump shaft for axial movement therewith, said disk having a peripheral portion and having a diameter size so as to engage said interior wall of said pump casing, said peripheral portion being made from a pliable rubber-like material and being upturned against said interior wall of said pump casing.

16. A crystal ball assembly as claimed in claim 1 wherein said crystal ball contains a colored fluid, the level of said colored fluid being at least as high as said upper surface of said frame top.

17. A crystal ball assembly as claimed in claim 16 wherein said pumping means further comprises a check valve in said pump shaft central bore and said crystal ball contains a clear liquid having a specific gravity less than said colored fluid, said moving means moving said pump shaft axially in a downward and an upward direction, said check valve preventing said clear liquid from being drawn into said pump shaft bore on the movement of said pump shaft in the downward direction.

18. A crystal ball pumping means for pumping a colored liquid through a spout located in a crystal ball, said pumping means comprising a stationary frame which has an interior chamber and includes a top lid having a top with a central bore therethrough and a plurality of peripheral orifices therethrough, and having depending walls with axial projections depending therefrom, said projections having bottom edges which define an undulating surface;

a bottom lid coupled with said top lid and having upstanding walls with flanges mounted thereon and a bottom with a central bore, said flanges mating with, but spaced apart from said projections so as to form an undulating guide rail therebetween;

a hollow pump casing having a hollow neck portion extending through said top central bore and rotatably mounted on said top lid, said pump casing having a wall defining an interior cavity;

a pump shaft having a side periphery, said pump shaft extending through said pump casing neck portion at an end of said neck portion and axially movably mounted in said neck portion, said pump shaft having a top axial bore therein which extends from an upper end of said pump shaft to a point therebelow, having a radial bore extending between said axial bore and an opening in said side periphery of said pump shaft, having a radially extending arm rigidly mounted at a bottom portion of said pump shaft, an end of said arm engaging said guide rail, having rotational locking means for rotationally locking said pump shaft to said pump casing, yet also for permitting relative axial movement between said pump shaft and said pump casing, and having a bottom bore through a bottom end of said pump shaft;

a pump piston means rigidly mounted around said pump shaft below said point and having a diameter so as to engage the interior cavity walls of said pump casing; and means for rotating said pump piston while permitting relative axial movement therebetween, said rotating means comprising a disk rotatably mounted on said frame bottom, and comprised of a plurality of upstanding columns mounted spaced apart on either side of said pump shaft arm so as to rotate said arm and hence said pump shaft, yet having a height so as to permit a maximum axial relative movement between said disk and said pump shaft, an upstanding central post which engages said pump shaft bottom bore, said central post and said bottom portion of said pump shaft having lengths so as to permit said maximum axial relative movement between said disk and said pump shaft, and a depending central shaft extending through said bottom lid central bore.

19. A fountain assembly comprising:

a base;

a spout having an exterior surface and an interior hollow and at least one nozzle through said exterior surface in communication with said hollow; and pumping means mounted to said base for pumping a fluid out through said spout nozzle, said pumping means comprising a stationary frame which has an interior chamber and includes a top having an upper surface, a top bore and a plurality of orifices through said upper surface, and a bottom coupled together with said top to form said chamber, said bottom having a bottom bore, and a pump casing rotatably mounted at said frame top inside said chamber and having an interior wall which defines an interior cavity, a pump shaft extending through said pump casing and rotatably and axially slidably mounted in said frame, said pump shaft having an axial bore therein in fluid communication with said pump casing cavity and said spout hollow, moving means for rotating and axially reciprocating said pump shaft, and pump piston means mounted on said pump shaft and located inside said pump casing cavity for forcing a fluid in said pump casing cavity out said pump shaft bore and out said spout.

* * * * *